US009626975B2

(12) United States Patent
Harma et al.

(10) Patent No.: US 9,626,975 B2
(45) Date of Patent: Apr. 18, 2017

(54) AUDIO SIGNAL PROCESSOR FOR PROCESSING ENCODED MULTI-CHANNEL AUDIO SIGNALS AND METHOD THEREFOR

(75) Inventors: Aki Sakari Harma, Eindhoven (NL); Arnoldus Werner Johannes Oomen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 205 days.

(21) Appl. No.: 14/124,048

(22) PCT Filed: Jun. 4, 2012

(86) PCT No.: PCT/IB2012/052795

§ 371 (c)(1), (2), (4) Date: Dec. 5, 2013

(87) PCT Pub. No.: WO2012/176084

PCT Pub. Date: Dec. 27, 2012

(65) Prior Publication Data

US 2014/0133661 A1 May 15, 2014

(30) Foreign Application Priority Data

Jun. 24, 2011 (EP) ..... 11171280

(51) Int. Cl.
*G10L 19/008* (2013.01)

(52) U.S. Cl.
CPC ..... *G10L 19/008* (2013.01); *H04S 2400/01* (2013.01); *H04S 2400/11* (2013.01); *H04S 2420/01* (2013.01)

(58) Field of Classification Search
CPC ..... G10L 19/008; H04S 2420/01; H04S 2400/11; H04S 2400/01
See application file for complete search history.

(56) References Cited

U.S. PATENT DOCUMENTS 5,864,820 A 1/1999 Case
6,983,251 B1 1/2006 Umemoto et al.
(Continued)

FOREIGN PATENT DOCUMENTS

GB 2321577 A 7/1998
JP 0430700 A 2/1992
(Continued)

OTHER PUBLICATIONS

Harma et al: "Spatial Track Transition Effects for Headphone Listening"; Proc. of the 10th Int. Conference on Digital Audio Effects (DAFx-07), Bordeaux, France, Sep. 2007, pp. DAFX-1-DAFX-6.

(Continued)

*Primary Examiner* — Ping Lee

(57) ABSTRACT

An audio signal processor receives a plurality of encoded multi-channel audio signals. A multi-channel decoder (105) decodes a first encoded multi-channel signal to generate a first decoded multi-channel signal. A generator (109) generates an encoded further audio signal by selecting audio encoding data from at least a second encoded multi-channel audio signal such that a number of channels of the encoded further audio signal comprising audio encoding data from the second encoded multi-channel audio signal is less than a number of channels in the second encoded multi-channel signal. Thus, a channel reduction is performed in the encoded data domain. A further decoder (111) generates a further decoded signal by decoding the further encoded audio signal. A combiner (107) combines the first decoded multi-channel signal and the further decoded signal to generate a multi-channel output signal. An exciting user experience can be provided while maintaining low complexity and resource usage.

15 Claims, 4 Drawing Sheets

(56) References Cited

U.S. PATENT DOCUMENTS

| | | | | |
|---|---|---|---|---|
| 7,043,312 | B1 | 5/2006 | Moorer | |
| 2003/0035553 | A1 | 2/2003 | Baumgarte et al. | |
| 2006/0013405 | A1 | 1/2006 | Oh et al. | |
| 2007/0244706 | A1 | 10/2007 | Tsushima | |
| 2008/0019531 | A1 | 1/2008 | Kimijima | |
| 2010/0254548 | A1* | 10/2010 | Kojima | G10L 19/173 381/119 |
| 2010/0316230 | A1 | 12/2010 | Oh et al. | |
| 2011/0153043 | A1* | 6/2011 | Ojala | G06F 3/0488 700/94 |

FOREIGN PATENT DOCUMENTS

| | | | |
|---|---|---|---|
| JP | 05300597 | A | 11/1993 |
| JP | 2001298680 | A | 10/2001 |
| JP | 2003122374 | A | 4/2003 |
| JP | 2007133738 | A | 5/2007 |
| JP | 2008028700 | A | 2/2008 |
| JP | 2008519301 | A | 6/2008 |
| JP | 2011509588 | A | 3/2011 |
| WO | 2006048226 | A1 | 5/2006 |
| WO | 2007067320 | A2 | 6/2007 |
| WO | 2007088490 | A1 | 8/2007 |
| WO | 2008142651 | A1 | 11/2008 |
| WO | 2009113021 | A1 | 9/2009 |

OTHER PUBLICATIONS

Brandenburg et al: "ISO-MPEG-1 Audio: A Generic Standard for Coding of High-Quality Digital Audio"; Journal of Audio Engineering Society, 1994, pp. 780-792.

De Smet et al: "Subband Based MPEG Audio Mixing for Internet Streaming Applications"; IEEE, 2001, pp. 1393-1396.

Herre et al: "New Concepts in Parametric Coding of Spatial Audio:From SAC to SAOC"; IEEE, 2007, pp. 1894-1897.

Oh et al: "Enhancing Stereo Audio With Remix Capability"; AES 129th Convention, 2010, Paper 8290, pp. 1-8.

Johnston et al: "Sum-Difference Stereo Transform Coding"; IEEE, 1992 pp. II-569-II-572.

Harma: "Spaceplayer: Browsing Interface for Media Collections"; Technical Note, Dec. 2010, 44 Page Document.

* cited by examiner

AUDIO SIGNAL PROCESSOR FOR PROCESSING ENCODED MULTI-CHANNEL AUDIO SIGNALS AND METHOD THEREFOR

CROSS-REFERENCE TO PRIOR APPLICATIONS

This application is the U.S. National Phase application under 35 U.S.C. §371 of International Application No. PCT/IB2012/052795, filed on Jun. 4, 2012, which claims the benefit of European Patent Application No. 11171280.8, filed on Jun. 24, 2011. These applications are hereby incorporated by reference herein.

FIELD OF THE INVENTION

The invention relates to an audio signal processor and method therefore, and in particular, but not exclusively to simultaneous rendering of multi-channel signals.

BACKGROUND OF THE INVENTION

In the last decades, the variety and flexibility of audio provision has increased dramatically. Indeed, the introduction of spatial audio, digital audio encoding and decoding, miniaturization of audio devices etc. has resulted in audio being consumed in many different ways. In addition, the additional opportunities and functionality have resulted in new user experiences and use scenarios being developed.

For example, audio devices have been developed which allow multiple source signals to be rendered simultaneously but being spatially differentiated. Such audio devices may decode a plurality of source signals to provide decoded signals which are then spatially processed such that they appear to a listener to originate from different directions. Examples of such audio players may be found in the article "Spatial Track Transition Effects for Headphone Listening" by Harma, A. and S. van de Par; 10th Int. Conf. Digital Audio Effects (DAFx 10); 2007; Bordeaux; France.

However, although such processing tends to provide an attractive user experience, it also tends to have associated disadvantages. In particular, the complexity and computational demand of the processing tends to be quite high thereby requiring relatively powerful processing platforms. This increases cost and power consumption which is particularly undesirable for small portable audio players for the consumer segment. Alternatively, complexity and processing demands are reduced by compromising the quality of the processing or restricting the number of audio source signals that can be processed. However, this results in a degraded user experience.

Hence, an improved approach would be advantageous, and in particular an approach allowing increased flexibility, reduced complexity, reduced computational demands, facilitated operation, reduced power consumption, improved audio quality, an improved user experience and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio signal processor comprising: a receiver for receiving a plurality of encoded multi-channel audio signals; a multi-channel decoder for decoding a first encoded multi-channel signal to generate a first decoded multi-channel signal; a generator for generating an encoded further audio signal by selecting audio encoding data from at least a second encoded multi-channel audio signal of the plurality of encoded multi-channel audio signals such that a number of channels of the encoded further audio signal comprising audio encoding data from the second encoded multi-channel audio signal is less than a number of channels in the second encoded multi-channel signal; a further decoder for generating a decoded further audio signal by decoding the encoded further audio signal; and a combiner for combining at least the first decoded multi-channel signal and the decoded further audio signal to generate a multi-channel output signal.

The invention may provide improved processing of a plurality of encoded multi-channel audio signals. In particular, a reduced complexity and/or computational resource can be achieved in many scenarios. An output signal comprising audio from a plurality of multi-channel audio signals may be generated without requiring a full multi-channel decoding of each multi-channel signal. The computational resource usage may be substantially decreased thereby allowing a larger number of multi-channel signals to be included in the multi-channel output signal. In many scenarios an improved user experience, reduced cost and/or facilitated implementation can be achieved.

The audio signal processor may further in some embodiments comprise means for rendering the multi-channel output signal, for example using headphones.

The encoded multi-channel audio signals may be encoded stereo signals. In some embodiments the multi-channel signals of the plurality of encoded multi-channel audio signals have an equal number of channels, and may specifically be encoded stereo signals.

The encoded further audio signal may be a multi-channel signal with fewer channels than the second encoded multi-channel audio signal. In other embodiments, the encoded further audio signal may have as many or even more channels than the second encoded multi-channel audio signal but encoding data from the second encoded multi-channel audio signal is only included in a subset of these channels, where the subset comprises fewer channels than the second encoded multi-channel audio signal.

The generator realizes a reduction in the number of channels of encoded audio data representing the audio source of the second encoded multi-channel audio signal. Specifically the generator may discard one or more of the channels of the second encoded multi-channel audio signal.

The second encoded multi-channel signal is typically different than the first encoded multi-channel signal.

In accordance with an optional feature of the invention, the generator is arranged to generate a first channel of the encoded further audio signal by selecting audio encoding data from a single channel of the second encoded multi-channel signal.

This may facilitate implementation and/or reduce complexity and/or reduce computational resource. In particular, it may allow a low complexity extraction/selection of audio data and does not necessitate any processing of the encoding data. The generator may select encoding data from only the single channel when generating the encoded further audio signal and may ignore or discard all other channels of the second encoded multi-channel audio signal.

The first channel may comprise encoding data from only the single channel of the second encoded multi-channel audio signal.

In accordance with an optional feature of the invention, the encoded further audio signal is a multi-channel signal and the generator is arranged to generate a second channel of the encoded further audio signal by selecting audio encoding data from a single channel of a third encoded multi-channel signal.

The encoded further audio signal may comprise encoding data from a plurality of encoded multi-channel signals. The encoded further audio signal may specifically be a multi-channel signal having the same number of channels as the first encoded multi-channel signal but with subsets of channels being selected from different encoded multi-channel signals.

The further decoder may be a multi-channel decoder and may perform a single multi-channel decoding of an encoded further audio signal comprising channels from different encoded multi-channel signals. Thus, a single multi-channel decoding may simultaneously decode audio from a plurality of the received encoded multi-channel signals. The further decoder may be the same as the multi-channel decoder used for decoding a first encoded multi-channel signal.

In accordance with an optional feature of the invention, the encoded audio data of the single channel of the encoded further audio signal is identical to encoded audio data of the single channel of the second encoded multi-channel signal.

This may allow for a particularly efficient and typically low complexity and/or low computational resource implementation. In some embodiments, the single channel of the encoded further audio signal may simply be generated by copying all audio encoding data from the single channel of the second encoded multi-channel signal.

In accordance with an optional feature of the invention, the single channel of the second encoded multi-channel signal is at least one of: a mid-channel for a mid-side stereo signal; a left channel for a right left-stereo signal; and a right channel for a right left-stereo signal.

This may provide particularly advantageous operation, performance and/or implementation. In particular, it may allow for a low complexity and low resource demanding implementation while providing a highly advantageous user experience.

In accordance with an optional feature of the invention, the encoded further audio signal is a mono-signal.

This may provide particularly advantageous operation, performance and/or implementation. In particular, it may allow a low complexity and resource demanding implementation while providing a highly advantageous user experience.

In accordance with an optional feature of the invention, the encoded further audio signal is a multi-channel signal having different channels comprising audio encoding data from different encoded multi-channel audio signals of the plurality of encoded multi-channel audio signals.

This may provide particularly advantageous operation, performance and/or implementation. In particular, it may allow a low complexity and resource demanding implementation while providing a highly advantageous user experience. The approach may in many scenarios allow a particularly efficient operation by use of a multi-channel decoder for simultaneously decoding audio corresponding to a plurality of different sound sources.

In accordance with an optional feature of the invention, each channel of the encoded further audio signal corresponds to one channel of one of the different encoded multi-channel audio signals.

This may allow a particularly efficient implementation.

In accordance with an optional feature of the invention, the generator is arranged to select audio encoding data for one channel of the encoded further audio signal from a plurality of encoded multi-channel audio signals.

This may allow an efficient implementation and may in particular in many scenarios substantially reduce the required decoding computational demand. A single channel of the encoded further audio signal may be generated by selecting encoding data from two (or more) channels from different encoded multi-channel audio signals. The selection of encoding data may for example be alternated between two encoded multi-channel audio signals in consecutive encoding segments. In some scenarios more complex selection may be applied, such as a selection dependent on a characteristic of the audio encoding data of at least one of the channels of the plurality of encoded multi-channel audio signals. For example, the encoding data corresponding to the strongest signal may be selected.

In accordance with an optional feature of the invention, the generator is arranged to generate encoding control data for the encoded further audio signal by modifying encoding control data of the second encoded multi-channel audio signal to correspond to the encoded audio data of the encoded further audio signal.

This may facilitate operation and allow standard equipment, such as standard decoder functionality, to process the encoded further audio signal. For example, header information indicative of a data rate may be modified from the data of the original encoded multi-channel audio signals to values that reflect the selection of audio encoding data when generating the encoded further audio signal. For example, the original encoded multi-channel audio signals may be mid-side signals and the encoded further audio signal may be generated as a stereo signal with each signal comprising the encoding data of the mid-channel for two different encoded multi-channel audio signals. In this case, the data rate of the encoded further audio signal will be higher than for the two mid-side encoded multi-channel audio signals, and the header data may be modified to reflect this.

In accordance with an optional feature of the invention, the audio signal processor further comprises: a user interface for receiving a user input; a spatial model representing a virtual user position and virtual spatial sound source positions associated with the plurality of encoded multi-channel audio signals; and wherein the generator is arranged to select the first encoded multi-channel signal and the second encoded multi-channel audio signal in response to the spatial model.

This may allow a very attractive user experience to be provided with reduced complexity. Specifically, as lower complexity is required for decoding, more virtual sound source positions may be rendered for the model thereby providing an enhanced user experience.

In some embodiments, the user interface may include a display for presenting a representation of the spatial model.

In accordance with an optional feature of the invention, the combiner is arranged to apply a spatial processing to at least the decoded further audio signal in response to the spatial model.

This may provide a highly advantageous user experience with an aurally provided spatial representation of the model.

In particular, if the user interface includes a display for presenting a representation of the spatial model, a combined audio visual spatial user experience can be provided. Furthermore, this can be achieved without requiring full decoding of all sound sources that are to be simultaneously spatially rendered. The generation of the encoded further audio signal may thus not only reduce complexity and resource usage for decoding but may also facilitate and reduce complexity and resources usage for the spatial rendering.

In accordance with an optional feature of the invention, the decoded further audio signal is a multi-channel signal and the spatial processing comprises spatially processing different channels of the decoded further audio signal to correspond to different virtual spatial sound source positions of the spatial model.

This may provide a highly advantageous user experience with an aurally provided spatial representation of the model.

In accordance with an optional feature of the invention, the combiner is arranged to select the second encoded multi-channel audio signal in response to a distance between the virtual user position and the virtual spatial sound source positions associated with the second encoded multi-channel audio signal.

This may provide a highly advantageous user experience with an aurally provided spatial representation of the model.

According to an aspect of the invention there is provided a method of processing an audio signal comprising: receiving a plurality of encoded multi-channel audio signals; decoding a first encoded multi-channel signal to generate a first decoded multi-channel signal; generating an encoded further audio signal by selecting audio encoding data from at least a second encoded multi-channel audio signal of the plurality of encoded multi-channel audio signals such that a number of channels of the encoded further audio signal comprising audio encoding data from the second encoded multi-channel audio signal is less than a number of channels in the second encoded multi-channel signal; generating a decoded further audio signal by decoding the encoded further audio signal; and combining at least the first decoded multi-channel signal and the decoded further audio signal to generate a multi-channel output signal.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to rendering of stereo audio items by an audio player, such as a portable audio player. However, it will be appreciated that the invention is not limited to this application but may be applied to many other audio signals and systems.

Figure 1:
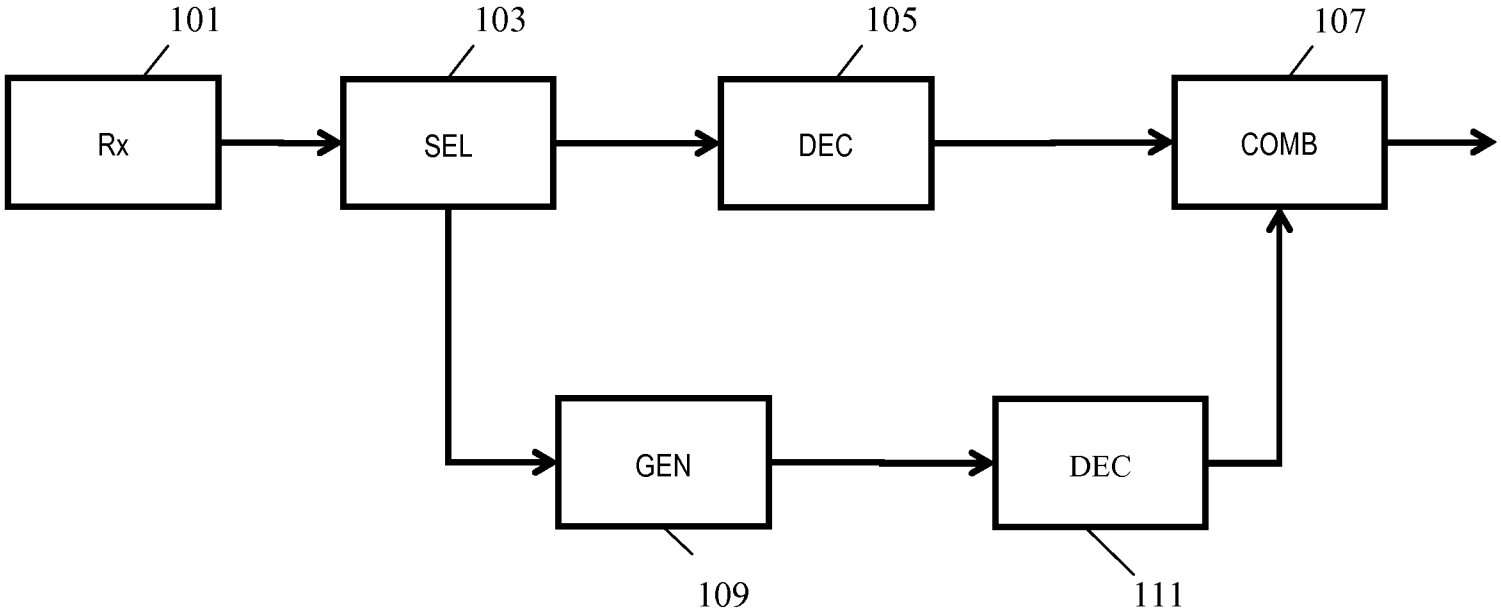
FIG. 1 illustrates an example of elements of an audio signal processor in accordance with some embodiments of the invention.

FIG. 1 illustrates an example of an audio signal processor in accordance with some embodiments of the invention.

The audio signal processor of FIG. 1 is specifically arranged to process a plurality of encoded multi-channel signals corresponding to a plurality of sound sources. Specifically, an output signal is generated which comprises audio components from a plurality of encoded input multi-channel signals. Each of the encoded multi-channel audio signals may be one audio item or entity, such as one encoded audio file (e.g. an MP3 encoded song).

In the specific example, spatial processing may further be introduced such that the different sound sources/audio items may be differentiated based on their spatial characteristics in the resulting signal. For example, the different songs may be rendered such that they are perceived to originate from different directions.

Thus, in the system of FIG. 1, a composite output signal is generated from a plurality of input signals such that a listener perceives a listening environment with a plurality of simultaneous sound sources. For example, a number of e.g. MP3 encoded songs may be simultaneously presented. The listener will thus be provided with a plurality of simultaneous audio items.

Conventionally, the rendering of simultaneous multi-channel signals is achieved by decoding all the multi-channel signals with a subsequent channel by channel mixing of the decoded multi-channel signals. For example, when simultaneously rendering two received encoded stereo signals, two stereo decoders are typically used to generate decoded stereo signals. The two decoded left channels are then mixed together to generate a left output channel. Similarly, the two decoded right channels are mixed together to generate a right output channel. However, such an approach is computationally demanding and is relatively complex. Indeed, in many applications, it is desirable to have perhaps three or four simultaneously rendered sound sources/audio items thereby requiring three or four simultaneous multi-channel decoders. However, the associated computational requirement is typically substantially higher than that typically available for e.g. portable applications, such as e.g. portable media or audio players. Indeed, in such devices there is typically a limit (e.g. 3) to the number of decoders that can be operated simultaneously.

The inventors have realized that for many applications wherein a plurality of multi-channel sound sources are simultaneously presented to a listener, it may be acceptable or indeed advantageous for the main source(s) to be provided in a full multi-channel rendering whereas other sources may be rendered with a reduced number of channels, and specifically in many scenarios may be rendered as mono signal(s). The system of FIG. 1 utilizes this fact together with a specific approach for generating such an output signal to substantially reduce complexity and computational resource. In particular, the system of FIG. 1 is arranged to select one (or more) of the input multi-channel signals to be rendered as a full multi-channel signal including applying a full multi-channel decoding and appropriate processing. However, for other multi-channel signal(s), a reduction in the number of channels is performed prior to decoding by directly manipulating the audio encoding data of the multi-channel signals. Only the resulting encoded channels are subsequently decoded. Since the complexity and resource requirement associated with decoding is typically one of the most significant factors in the overall complexity and resource usage, this results in a very substantial reduction in the overall complexity and computational resource usage.

The audio signal processor of FIG. 1 comprises a receiver 101 which receives a plurality of encoded multi-channel audio signals. Thus, a number of input signals are received where each input signal is a multi-channel signal representing a sound source. In the example, each input signal is an individual audio item and specifically is an audio file, such as a song. In the example, the input signals represent separate and unrelated sound sources. Thus, each input signal represents a sound stage or environment which is independent of the sound stage or environment of other input signals. There is accordingly no spatial, audio and/or perceptual correlation between the input signals but these can be individually rendered without any consideration of any of the other input signals.

Furthermore, each input signal is encoded in accordance with a suitable encoding standard or algorithm. For example, the data may be encoded in accordance with an MP3, AAC etc. encoding. The encoding is specifically a lossy, perceptual encoding of multi-channel audio.

The input multi-channel signals may be stereo signals or may comprise more channels, such as e.g. is the case for a five or seven channel surround signal. The following description will focus on an example where the input signals are stereo signals, but it will be appreciated that the described principles and approaches apply equally to input signals with more channels.

In the example, the input signals are specifically received from an internal storage medium which has stored upon it a large number of encoded audio files, such as MP3 or AAC encoded songs. The receiver 101 may in this example comprise functionality for extracting the audio files from the storage medium. The storage medium may for example be a hard disk or a semi-permanent memory. The extraction of the files from the storage medium may be controlled by a user selection received via a suitable user interface.

As another example, the input signals may be real-time signals which for example are being streamed from a source on the Internet or received via digital radio broadcasting. The input signals may further be received from the same source or may e.g. be received from separate and independent sources.

The receiver 101 is coupled to a selector 103 which is fed the received (in the specific example extracted) encoded multi-channel signals. The system of FIG. 1 is arranged to generate a multi-channel output signal wherein one of the input encoded multi-channel signals is included as a full multi-channel signal whereas the other encoded multi-channel signals are included as reduced channel signals. Thus, for one input encoded multi-channel signal (which is henceforth referred to as the primary signal) with N channels, the output signal will include all N channels. However, for the remaining encoded multi-channel signals, only an M channel representation is included in the output signal where M<N. In the specific example, the encoded multi-channel signals are encoded stereo signals, and the audio signal processor generates an output stereo signal wherein one of the input signals is provided as a stereo signal whereas the other signals are included only as mono-signals.

The selector 103 specifically selects one primary signal. The remaining encoded multi-channel signals will henceforth be referred to as secondary signals.

The selector 103 is coupled to a multi-channel decoder 105 which is fed the encoded primary signal. The multi-channel decoder 105 decodes the primary encoded multi-channel signal to generate a primary decoded multi-channel signal. In the specific example, the encoded primary signal is a stereo signal and the multi-channel decoder 105 is a stereo decoder generating a decoded stereo signal.

The multi-channel decoder 105 is coupled to an output processor 107 which generates a multi-channel output signal that comprises the primary decoded multi-channel signal.

The selector 103 is further coupled to a generator 109 which is fed the secondary encoded multi-channel signals. The generator 109 generates at least one reduced channel encoded audio signal by selecting audio encoding data from one or more of the secondary encoded multi-channel signals. The reduced channel encoded audio signal is generated from audio encoding data of one or more of the secondary encoded multi-channel signals. However, the number of channels in the reduced channel encoded audio signal is less than the sum of channels in the secondary encoded multi-channel signals that are used to generate the reduced encoded multi-channel signal. Thus, for at least one of the secondary encoded multi-channel signals included in the reduced channel encoded multi-channel signal, the number of channels is reduced.

Accordingly, the generator 109 introduces a reduction in the number of channels used to represent the audio from the second encoded multi-channel signals. Furthermore, this reduction is achieved by a selection of audio encoding data from the encoding data of the secondary encoded multi-channel signals. Thus, simple data movement, selection, and combination operations may be used to generate a reduced channel encoded audio signal and no decoding or other processing of the underlying audio signal(s) is required. The channel reduction is therefore achieved with low complexity and without significant resource requirement.

The generator is coupled to a second decoder 111 which is fed the reduced channel encoded audio signal. The second decoder proceeds to decode the reduced channel encoded audio signal to generate a reduced channel decoded multi-channel signal, henceforth referred to as the secondary decoded signal.

The second decoder 111 is coupled to the output processor 107 which is fed the secondary decoded signal. The output processor 107 includes the secondary decoded signal in the multi-channel output signal. Thus, the multi-channel output signal is generated as a combination of the decoded primary signal and the decoded secondary signal.

As a low complexity example, the output processor 107 may simply perform an audio mixing of the decoded primary signal and the decoded secondary signal. For example, one channel of the decoded primary signal may be mixed with one channel of the decoded secondary primary signal. If the secondary primary signal is a multi-channel signal, the mixing may be repeated for all channels such that each channel of the decoded audio signal is mixed with one channel of the decoded primary signal.

Thus, the output processor 107 generates a multi-channel output signal comprising a primary audio source represented as a full multi-channel signal and one or more secondary audio sources represented as reduced channel signals. As a specific example, a primary stereo input source may be represented as a full stereo representation whereas two secondary stereo input sources are simultaneously represented as two mono-representations. In this example, the two secondary sources may be perceived localized to the right ear and left ear respectively, whereas the primary signal fills out the entire sound stage.

In some embodiments, the output circuit 107 may directly generate a multi-channel signal which can drive suitable means for rendering the audio of the multi-channel signal. For example, the output circuit 107 may directly generate a stereo signal driving a pair of headphones or may e.g. generate five spatial channels for the different speakers of a five channel surround sound system. In other scenarios, the output circuit 107 may simply generate a signal for processing and rendering by other functionality, devices or equipment. Indeed, in some embodiments, the output circuit 107 may comprise functionality for encoding the output multi-channel signal thereby allowing it to be easily communicated, distributed or stored.

The inventors of the present invention have realized that an attractive user experience can be achieved with a specific simultaneous rendering of multiple audio sources while reducing complexity and resource requirements. Specifically, the inventors have realized that an attractive user experience can be achieved by maintaining one sound source (or a subset of sound sources) at the full multi-channel representation while reducing the multi-channel nature of other sound sources. Not only may this provide an attractive user experience which e.g. emphasizes the primary sound source(s) relative to the secondary sound source(s) but it can also be used to reduce complexity. Indeed, the inventors have realized that a substantial complexity/computational load reduction can be achieved by exploiting the specific rendering approach with an encoding domain (pre-decoding) channel reduction of the secondary signals based on a selection of audio encoding data. The system may in particular reduce the resource required for decoding of signals. As the computational demand of decoding operations is often a dominant resource load for audio processing units (especially for low resource devices such as portable audio players), the overall load reduction for the system as a whole is often substantially reduced.

The channel reduction of the generator 109 may in many scenarios include generating a channel of the reduced channel encoded audio signal to include the audio data of one of the channels of one of the secondary encoded multi-channel signals. Thus, the generator 109 may in some embodiments simply select all the audio encoding data for a single channel of a secondary encoded multi-channel signal and include it in a single channel of the reduced channel encoded audio signal. Hence, a straightforward bit selection can be used to generate the reduced channel encoded audio signal.

The single channel may represent one of the original audio channels in the content or, depending on the type of the audio coder, some linear combination of those. For example, common stereo audio coders encode the sum and difference signals of the left and right input audio channels instead of the original left and right signals. In this case, the generator 109 could, for example, select only the sum signal.

In some embodiments, one channel of the reduced channel encoded audio signal may thus comprise encoded audio data which is identical to a single channel of one of the secondary encoded multi-channel signals. The reduced channel encoded audio signal may be generated by a simple channel selection from one or more secondary encoded multi-channel signals. This channel selection selects a subset of the available channels and discards some channels thereby resulting in an overall reduction of channels.

It will be appreciated that in embodiments where the encoded audio data for the reduced channel encoded audio signal is simply selected by taking the audio encoding data from one or more channels of the secondary encoded multi-channel signals, other data such as overhead data, control data, formatting data etc. may be modified (or may not be transferred, i.e. new data may be generated). Thus, in some embodiments only the encoded audio data describing the underlying audio signal may be extracted whereas overhead data is not transferred to the reduced channel encoded audio signal or is modified in the process of doing so.

As a specific example, the generator 109 may receive a single secondary encoded multi-channel signal and may proceed to generate a mono-signal simply by selecting one of the channels of the secondary encoded multi-channel signals. The secondary encoded multi-channel signal may specifically be a stereo signal and the generator may reduce this to being a mono signal by selecting one channel of the stereo signal.

The secondary encoded multi-channel signal may specifically be a stereo signal which is encoded as a mid-side signal, and the generator 109 may generate the mono encoded audio signal by selecting the mid-channel. This results in a mono signal which contains most of the non-spatial audio information and which accordingly is particularly suitable for rendering as a mono signal without unacceptable information loss.

In scenarios where the secondary encoded multi-channel signal is a stereo signal encoded as a left and right signal, the generator 109 may generate the mono encoded audio signal by selecting either of the left and the right channels. This may be done randomly or may be based on a characteristic of the signal. For example, the signal with the highest average amplitude may be selected.

Thus, in some embodiments, the generator 109 may simply select a channel of one of the secondary encoded multi-channel signals to generate an encoded mono signal. This signal can then be decoded by a mono-decoder to generate a decoded mono signal which can be combined with the primary decoded multi-channel signal. Thus, the decoder 111 may be a simple mono-encoder. As the complexity and resource usage of a mono-decoder is substantially lower than that of multi-channel encoders, including stereo-decoders, a very substantial complexity and power reduction is achieved.

The approach is furthermore not limited to a single secondary encoded multi-channel signal. Rather, a plurality of secondary encoded multi-channel signals may individually be converted to encoded mono-signals. Each of the encoded mono-signals may individually be decoded to generate decoded mono-signals. The plurality of decoded mono-signals may then be mixed with the primary decoded multi-channel signal.

As a specific example, three encoded stereo signals may be simultaneously rendered. One stereo signal is decoded as a stereo signal and rendered as a stereo signal. For the two other stereo signals, an encoded domain channel reduction is performed to reduce them to encoded mono signals. A mono encoder decodes the signals and the resulting decoded signals may be added to the left and right output channels respectively. Thus, the user will be presented with a simultaneous rendering of one full main stereo signal together with a mono signal in each ear.

In some embodiments, the reduced channel encoded audio signal may be generated to include contributions from a plurality of encoded multi-channel signals. Specifically, the reduced channel encoded audio signal may itself be a multi-channel signal which is generated from a plurality of secondary encoded multi-channel signal. Specifically, each of the channels of the reduced channel encoded audio signal may be generated by selecting a channel from one secondary encoded multi-channel signals. For example, instead of generating two mono signals as previously mentioned, the generator 109 may generate an encoded stereo signal by selecting one channel from one secondary encoded multi-channel signal and one channel from a different encoded multi-channel signal. The resulting stereo signal may then be decoded by a stereo decoder, i.e. the second decoder 111 may be a stereo decoder. Specifically, the multi-channel decoder 105 and the second decoder 111 may be implemented as the same decoder which sequentially decodes the primary multi-channel signal and the reduced channel encoded audio signal. The resulting decoded secondary stereo signal can then be mixed with the primary decoded stereo signal, e.g. simply by summing the two stereo signals.

In some embodiments, the reduced channel encoded audio signal may accordingly be a multi-channel signal made by the generator 109 generating a first channel by selecting audio encoding data from one channel of one of the secondary encoded multi-channel signal and a second channel by selecting audio encoding data from one channel of another of the secondary encoded multi-channel signal.

More specifically, the encoded representations of the mid signals (i.e. the sums of the left and right channels in the original stereo items) of two mid-side encoded signals may be included in the two channels of a single stereo signal. This audio encoding data is stored as part of the stereo bit stream for the signal as indicated by suitable data headers and/or and the respective definition of the encoded bitstream, such as e.g. described for MP3 in Brandenburg, K., "{ISO-MPEG-1} Audio: A Generic Standard for Coding of High-Quality Digital Audio". J. Audio Eng. Soc., 1994. 42: p. 780-792 for the case of MPEG-I layer III encoded (MP3) data.

The audio encoding data of the mid channel data streams from the two input audio signals are then added into left and right data fields of a new bit stream container representing the reduced channel encoded audio signal. If the input signals are not mid-side coded but rather left-right coded, the regulator 109 may instead simply select the audio encoding data from either the left or the right channel from each input bitstream.

In some embodiments, the generator 109 is further arranged to modify encoding control data of the second encoded multi-channel audio signal to correspond to the encoded audio data of the encoded further audio signal. The encoding control data may be overhead data defining characteristics of the reduced channel encoded audio signal itself rather than representing the underlying audio. The encoding control data may for example be metadata, such as e.g. data defining positions of different data in the bitstream, a data rate, which options are used etc.

As a specific example, the encoding data rate for two mid signals of two mid-side stereo signals will typically be substantially higher than the data rates of each of the two mid-side stereo signals as the data rate for a mid-channel is typically substantially larger than for a side channel. The generator may accordingly modify (set) the data of the reduced channel encoded bitstream which indicates the current data rate to correspond to the resulting data rate for the reduced channel encoded audio signal.

Thus, the reduced channel encoded audio signal may be generated to correspond to an encoded audio signal in accordance with an audio encoding standard, which specifically may be the same encoding standard as the input encoded multi-channel signals. This allows the reduced channel encoded audio signal to be treated like any other encoded audio signal and specifically allows a standard decoder to be used as the second decoder 111.

In some embodiments, the generator 109 may select encoding data for one channel of the encoded further audio signal from a plurality of encoded multi-channel audio signals. Thus, in some embodiments, a single channel of the reduced channel encoded audio signal may be generated by combining audio encoding data from two or more secondary encoded multi-channel signals. The selection of which audio encoding data to include may be performed in time and/or frequency segments wherein the selection is based on the characteristics of the audio encoding data in each segment.

Specifically, a channel of each of two or more secondary audio signals can by the generator 109 be combined in their encoded representation into a single channel of the reduced channel audio stream. This can be performed as operations of copying audio encoding data of individual bit streams into a common bitstream. In one possible embodiment, the combination is performed such that the energy of the signal in each encoded subband (represented by the values of scale factor band coefficients in the encoded bit stream) is used to determine which input audio signal is placed into the new bit stream.

In some embodiments, the audio signal processor may comprise functionality for applying a spatial processing to at least one of the decoded audio signals. The spatial processing may typically be applied to the decoded audio signals prior to these being mixed together. The spatial processing may be applied to perceptually position the different channels at different positions when perceived by the user.

Figure 2:
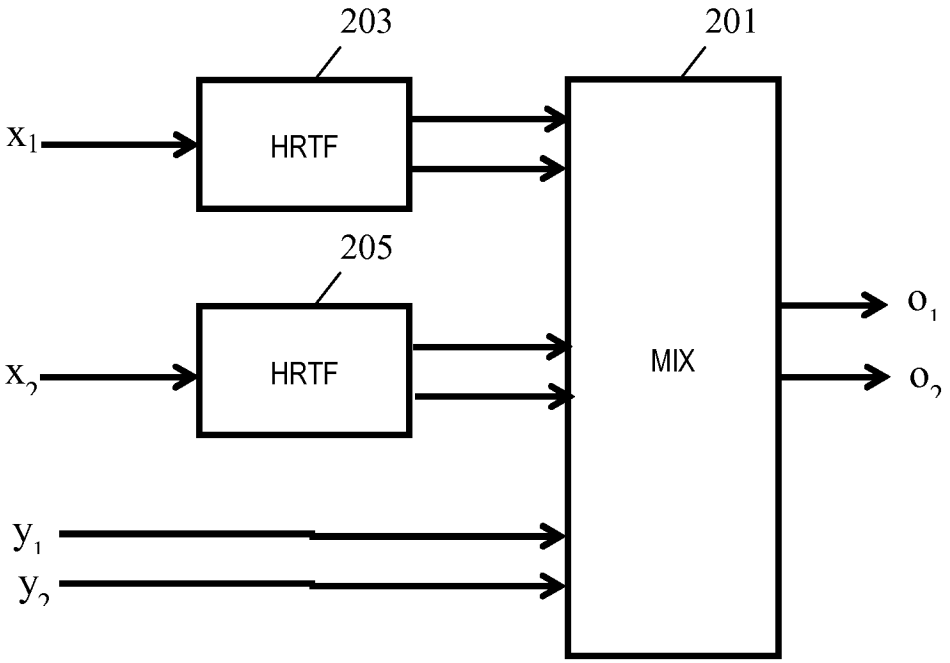
FIG. 2 illustrates an example of elements of a signal combiner for an audio signal processor in accordance with some embodiments of the invention.

FIG. 2 illustrates an example of the combiner 107 of FIG. 1 arranged to perform spatial processing for the secondary sound sources. In the example, the decoded primary audio signal ($y_1$, $y_2$) is not spatially processed but is fed directly to a mixer 201 which performs a mixing in the form of a weighted summation (or simply a summation). The decoded primary audio signal ($y_1$, $y_2$) is directly included in the stereo output signal ($o_1$, $o_2$) and thus the user is provided with the spatial stereo experience of the original encoded stereo signal.

However, in the example, each channel of the secondary decoded audio signals (($x_1$, $x_2$) are spatially processed such that they are perceived to originate from a given position in the audio scene. The spatial processing may be varied thereby allowing the combiner 107 to move the perceived single point mono sound source to a desired position.

In the example, the output signal is rendered using headphones and only two secondary audio sources are rendered. The combiner 107 comprises a first spatial processor 203 which receives one channel of the decoded secondary audio signal and a second spatial processor 205 which receives another channel of the decoded secondary audio signal. The spatial processors 203, 205 are specifically arranged to apply a Head Related Transfer Function (HRTF) to the different channels resulting in output signals that are perceived to originate from a given position. Each spatial processor 203, 205 accordingly generates a stereo output signal corresponding to the desired position for the audio source. These stereo output signals are fed to the mixer 201 which mixes them with the primary decoded stereo signal. The output of the mixer 201 is accordingly a spatial audio signal which comprises the primary stereo signal maintained as the original stereo signal and thus with a wider stereo soundstage. In addition, two single point audio sources are generated at positions that can be moved spatially to appear to come from any desired position.

The system can thus provide a simultaneous rendering of a plurality of audio sources (e.g. it can simultaneously play back a plurality of audio items) with only one (or a subset) of the audio items being rendered in full stereo playback. All other rendered audio items are spatially positioned and rendered as monophonic sound sources. Not only have the inventor's realized that such an approach provides a very advantageous user experience in many scenarios, but in addition a very efficient processing is achieved. Indeed, the system utilizes this insight further to create a system wherein a pre-decoding channel reduction is performed thereby reducing complexity and resource used by the decoding process. This leads to significant savings in computation and memory requirements, and also program memory space due to efficient reuse of existing software blocks.

Figure 3:
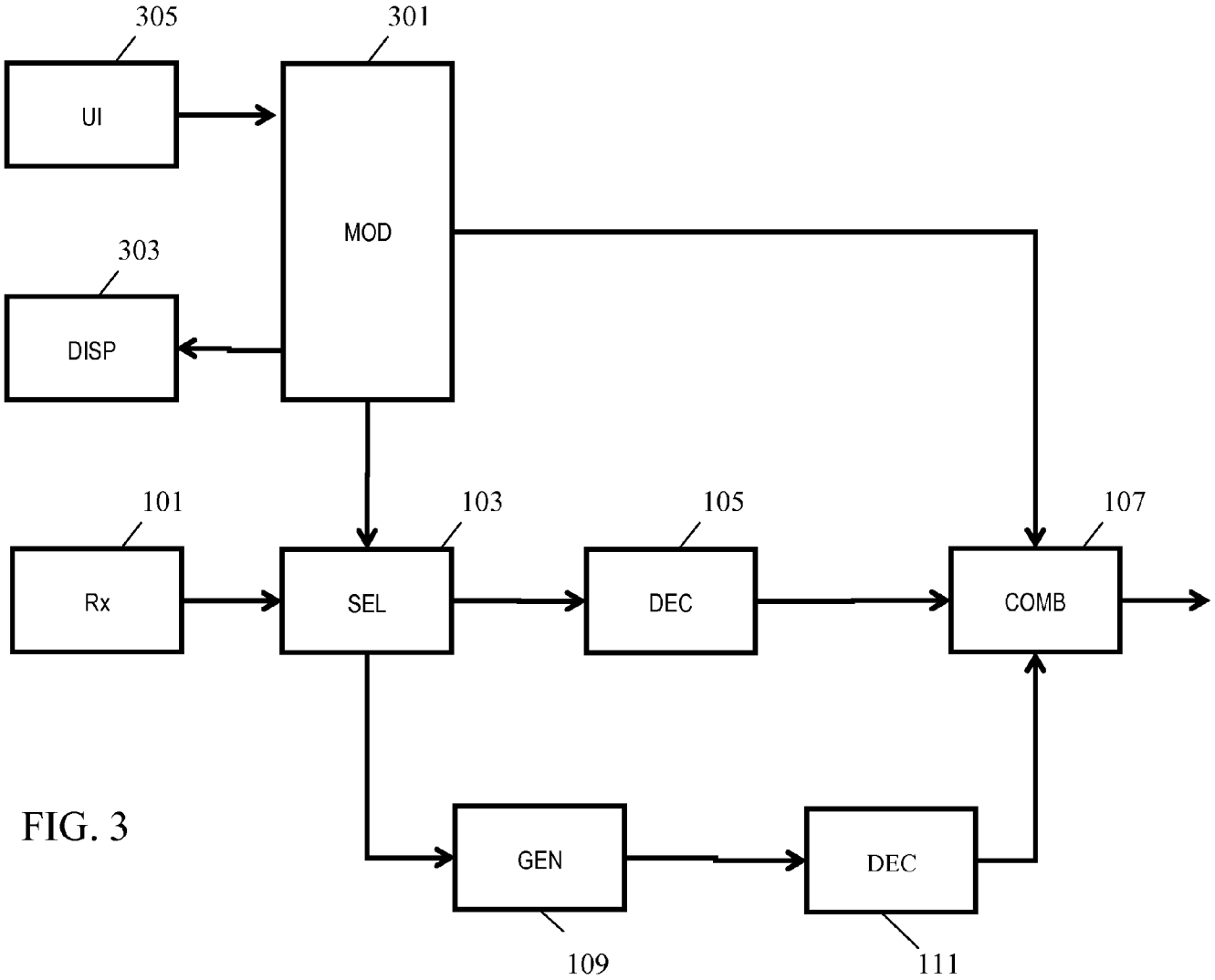
FIG. 3 illustrates an example of elements of an audio signal processor in accordance with some embodiments of the invention.

The described approach of simultaneous rendering of a plurality of encoded multi-channel signals can provide a particularly advantageous user experience when used together with a spatial model based user interface. FIG. 3 illustrates an example of an audio processing unit wherein the spatial processing and spatial positioning of sound sources is dependent on a spatial model and an associated user interface.

The audio processing unit corresponds to that of FIG. 1 but in addition it comprises a spatial model 301 which represents a virtual user position and virtual spatial sound source positions for the encoded multi-channel audio signals. Furthermore, the spatial model 301 is coupled to a display 303 which may display a graphical representation of (parts of) the model.

In the example, the spatial model 301 may be implemented on a suitable processing platform and may for example contain a virtual three dimensional position for all the audio items that could possibly be rendered. E.g., the spatial model 301 may have a position for each encoded song stored in a suitable storage medium. The position may for example be determined based on characteristics for the song, song as style, genre, artist, title, length etc.

The spatial model 301 may furthermore keep track of a virtual user position which may be changed in response to a user input. Thus the user may be provided with a user interface where he can move around between the audio items in the virtual spatial mode 301. The spatial model 301 is accordingly connected to a user input 305 which can receive an external user input. The user input 305 may for example be a touch input of the display 303. The display 303 may continuously present a graphical representation of a locality of the user position as the user position is moved within the spatial model. The representation may be a two dimensional representation with the user position represented e.g. by an icon and the audio items as other icons.

Figure 4:
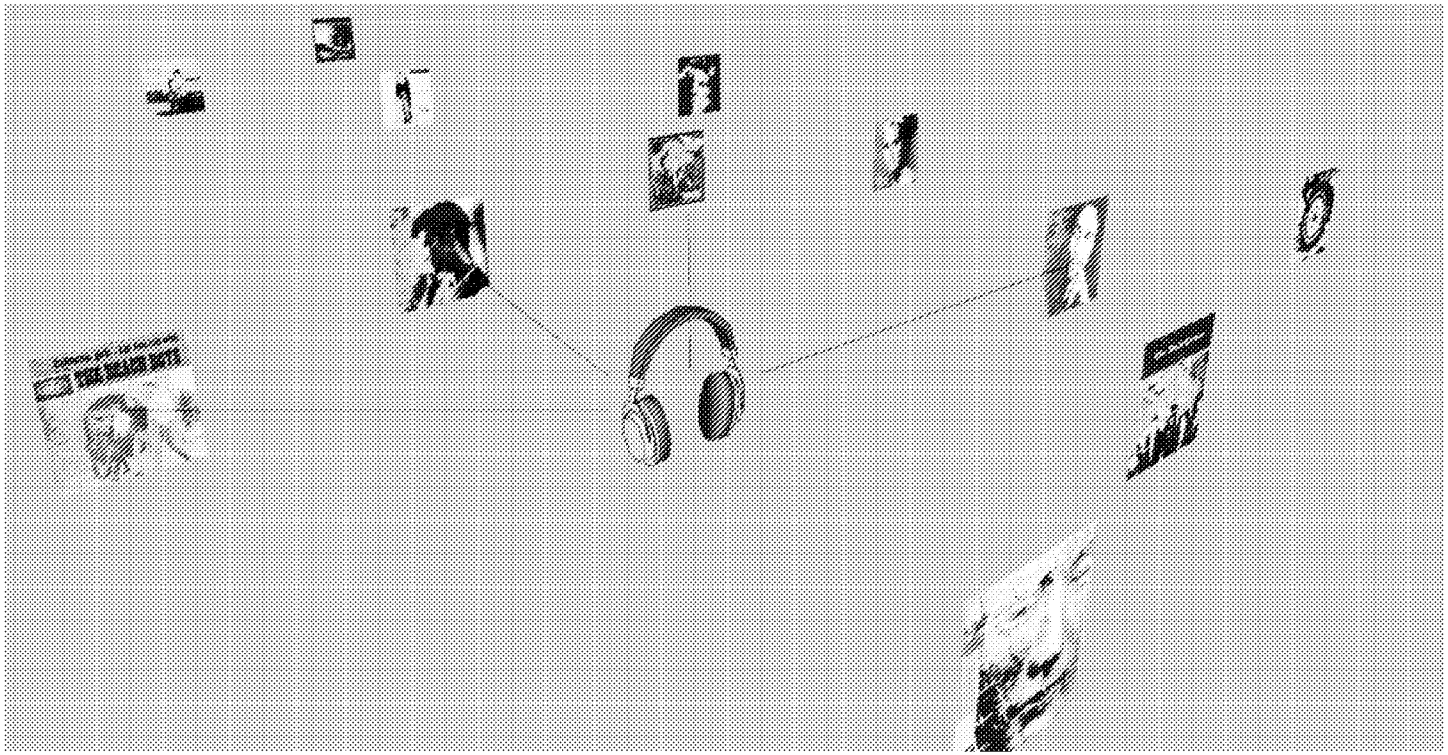
FIG. 4 illustrates an example of a visual representation of a spatial model of a collection of audio items.

FIG. 4 illustrates an example of such a representation. In the example a user may browse a collection of songs with multiple songs being simultaneously audible but rendered to different locations corresponding to the spatial model and the presentation on the display. In the example, the virtual position of the user is shown by the headphones and the album icons represent the audio items which according to the model are "visible" from the virtual user's position.

In the system, the primary encoded multi-channel signal and the secondary encoded multi-channel signals are selected based on the spatial model. Specifically, the primary encoded multi-channel signal may be selected as the audio item closest to the user in the model, and the secondary encoded multi-channel signals may be selected as e.g. the two next closest audio items. Thus, in the example, when the user moves close to one of the audio items, the corresponding audio stream is seamlessly converted to full stereo playback. At the same time, the other audio items are presented as mono-signals and may be spatially processed to be rendered from positions corresponding to the relative position in the model. Thus, the other nearby audio items may be rendered e.g. as muted signals in the background. This may provide a very attractive user experience and may e.g. provide a particularly advantageous browsing experience.

The spatial rendering may specifically apply different spatial processing to the different channels of the secondary decoded audio signal. In particular, in the example where the secondary decoded audio signal is a stereo signal with the different channels corresponding to different input audio sources, the spatial processing of one channel may correspond to the relative virtual position of the corresponding audio item whereas the spatial processing of the other channel may correspond to the relative virtual position of the other audio item.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. An audio signal processor comprising:

a receiver for receiving a plurality of encoded multi-channel audio signals;

a multi-channel decoder for decoding a first encoded multi-channel signal of the plurality of encoded multi-channel audio signals to generate a first decoded multi-channel signal;

a generator for extracting an encoded further audio signal by selecting encoded audio data from at least a second encoded multi-channel audio signal of the plurality of encoded multi-channel audio signals such that a number of channels of the encoded further audio signal comprising encoded audio data from the second encoded multi-channel audio signal is less than a number of channels in the second encoded multi-channel signal;

a further decoder for generating a decoded further audio signal by decoding the encoded further audio signal; and a combiner for combining at least the first decoded multi-channel signal and the decoded further audio signal to generate a multi-channel output signal.

2. The audio signal processor of claim 1 wherein the generator is arranged to extract a first channel of the encoded further audio signal by selecting encoded audio data from a single channel of the second encoded multi-channel signal.

3. The audio signal processor of claim 2 wherein the encoded further audio signal is a multi-channel signal and the generator is arranged to generate a second channel of the encoded further audio signal by selecting encoded audio data from a single channel of a third encoded multi-channel signal.

4. The audio signal processor of claim 2 wherein the encoded audio data of the single channel of the encoded further audio signal is identical to encoded audio data of the single channel of the second encoded multi-channel signal.

5. The audio signal processor of claim 2 wherein the single channel of the second encoded multi-channel signal is at least one of:

a mid-channel for a mid-side stereo signal;

a left channel for a right left-stereo signal; and a right channel for a right left-stereo signal.

6. The audio signal processor of claim 1 wherein the encoded further audio signal is a mono-signal.

7. The audio signal processor of claim 1 wherein the encoded further audio signal is a multi-channel signal having different channels comprising encoded audio data from different encoded multi-channel audio signals of the plurality of encoded multi-channel audio signals.

8. The audio signal processor of claim 7 wherein each channel of the encoded further audio signal corresponds to one channel of one of the different encoded multi-channel audio signals.

9. The audio signal processor of claim 1 wherein the generator is arranged to select encoded audio data for one channel of the encoded further audio signal from a plurality of encoded multi-channel audio signals.

10. The audio signal processor of claim 1 wherein the generator is arranged to extract encoding control data for the encoded further audio signal by modifying encoding control data of the second encoded multi-channel audio signal to correspond to the encoded audio data of the encoded further audio signal.

11. The audio signal processor of claim 1 further comprising:

a user interface for receiving a user input;

a spatial mode representing a virtual user position and virtual spatial sound source positions associated with the plurality of encoded multi-channel audio signals; and wherein the generator is arranged to select the first encoded multi-channel signal of alit of encoded mufti-channel signals and the second encoded multi-channel audio signal in response to the spatial model.

12. The audio signal processor of claim 11 wherein the combiner is arranged to apply a spatial processing to at least the decoded further audio signal in response to the spatial model.

13. The audio signal processor of claim 11 wherein the decoded further audio signal is a multi-channel signal and the spatial processing comprises spatially processing different channels of the decoded further audio signal to correspond to different virtual spatial sound source positions of the spatial model.

14. The audio signal processing of claim 11 wherein the combiner is arranged to select the second encoded multi-channel audio signal in response to a distance between the virtual user position and the virtual spatial sound source positions associated with the second encoded multi-channel audio signal.

15. A method of processing an audio signal comprising:

receiving a plurality of encoded multi-channel audio signals;

decoding a first encoded multi-channel signal of the encoded channel audio signals to generate a first decoded multi-channel signal;

extracting an encoded further audio signal by selecting encoded audio data from at least a second encoded multi-channel audio signal of the plurality of encoded multi-channel audio signals such that a number of channels of the encoded further audio signal comprising encoded audio data from the second encoded multi-channel audio signal is less than a number of channels in the second encoded multi-channel signal;

generating a decoded further audio signal by decoding the encoded further audio signal; and combining at least the first decoded multi-channel signal and the decoded further audio signal to generate a multi-channel output signal.

* * * * *